United States Patent [19]

Pomponi, Jr.

[11] Patent Number: 4,650,119

[45] Date of Patent: Mar. 17, 1987

[54] AIR SPRAY GUN

[75] Inventor: Edward A. Pomponi, Jr., Niwot, Colo.

[73] Assignee: Binks Manufacturing Company, Franklin Park, Ill.

[21] Appl. No.: 802,040

[22] Filed: Nov. 26, 1985

[51] Int. Cl.[4] ..... B05B 1/26

[52] U.S. Cl. ..... 239/296; 239/300; 239/413; 239/417.5

[58] Field of Search ..... 239/290, 296, 297, 300, 239/413, 417.5, 443, 444

[56] References Cited

U.S. PATENT DOCUMENTS

| | | | |
|---|---|---|---|
| 1,219,642 | 3/1917 | Isaacs | 239/300 |
| 2,438,471 | 3/1948 | Ball | 239/300 |
| 2,569,251 | 9/1951 | Nieburg | 239/297 X |
| 4,501,394 | 2/1985 | Kwok | 239/296 |

FOREIGN PATENT DOCUMENTS

| | | | |
|---|---|---|---|
| 510049 | 7/1939 | United Kingdom | 239/290 |
| 727237 | 4/1980 | U.S.S.R. | 239/297 |

*Primary Examiner*—Andres Kashnikow

*Attorney, Agent, or Firm*—Gary, Juettner & Pyle

[57] ABSTRACT

An improved air atomizing spray gun accommodates selective control over flows of air for atomizing liquid coating material into a conically-shaped spray and for forming the spray into a fan-shaped pattern. In one arrangement of the gun structure, respective supplies of atomizing and fan-shaping air are connected to the gun and separately coupled to atomizing and fan air outlet orifices. In another arrangement, only the supply of atomizing air is connected to the gun, and a valve on the gun adjustably diverts a portion of the atomizing air for fan-shaping purposes.

5 Claims, 9 Drawing Figures

BEST AVAILABLE COPY

AIR SPRAY GUN

BACKGROUND OF THE INVENTION

The present invention relates to air atomizing spray guns, and in particular to an improved air atomizing spray gun which accommodates selective control over atomizing and fan-shaping air emitted from the gun.

As is known, air atomizing spray guns have a circular fluid outlet orifice from which a cylindrical stream of liquid coating material or paint is emitted. Circumferentially surrounding the fluid orifice is an annular orifice through which atomizing air flows for interaction with the fluid stream to mechanically atomize it into an expanding, conically-shaped spray. Although articles may be coated with a conically-shaped spray, for uniformity of coating application it is usually desirable that the spray be fan-shaped. Therefore, such spray guns customarily also have means for impinging jets of air against opposite sides of the conically-shaped spray to form or flatten it to a fan shape.

Conventionally, air spray guns have a single air inlet for receiving air under pressure and directing it through passages to the atomizing air orifice, and a valve for diverting a portion of the air to the fan-shaping air orifices. A disadvantage is that for a given pressure of air supplied to the gun, the greater the amount of fan air required to form a properly shaped spray pattern, the less air will be available for atomization purposes.

It is desirable that an air spray gun emit the least amount of air necessary for proper atomization and fan-shaping, whereby to minimize air supply requirements as well as overspray and bounceback. Low solids coating materials, i.e., those having a relatively low ratio of pigment to solvent, require less air to atomize than high solids coating materials, so with low solids materials increases in fan-shaping air can usually be made without adversely affecting atomization quality. However, when spraying high solids materials, it often is not possible to increase fan air at the expense of atomizing air without impairing the quality of atomization. Although the pressure of air supplied to the gun may be adjusted to accommodate satisfactory atomizing and fan air flow rates while maintaining an overall minimum level of air emission from the gun, the expedient is inconvenient, since the air pressure regulator is usually at a position remote from the gun.

OBJECT OF THE INVENTION

A primary object of the present invention is to provide an improved air atomization spray gun which is structured to accommodate either precise and separate control over atomizing and fan-shaping air emitted from the gun, or control over fan-shaping air that is diverted from atomizing air.

SUMMARY OF THE INVENTION

The present invention provides an improved air atomizing spray gun for liquid coating material. The spray gun comprises a body and a nozzle assembly mounted on the body, and the nozzle assembly has fluid outlet orifice means for emitting coating material, atomizing air orifice means for emitting air for atomizing the coating material into a conically-shaped spray, and fan air orifice means for emitting air to flatten the conical spray into a fan-shaped pattern. The body has first and second air inlets, each for connection with a separate supply of air under pressure, first passage means extending between the first air inlet and the atomizing air orifice means, second passage means extending between the second air inlet and the fan air orifice means, and third passage means extending between the first and second passage means. Means are also provided for selectively blocking the third passage means between the first and second passage means, and for selectively blocking one of the air inlets. The arrangement is such that when the third passage means is blocked and neither of said air inlets is blocked, each of said atomizing air and fan air orifice means receives air under pressure from a respective and separate supply thereof, but so that when the third passage means is unblocked to interconnect the first and second passage means, and one of the air inlets is blocked, the atomizing air and fan air orifice means each then receive air under pressure from the same supply thereof.

The foregoing and other objects, advantages and features of the invention will become apparent upon a consideration of the following detailed description, when taken in conjunction with the accompanying drawings.

DETAILED DESCRIPTION

Figure 1:
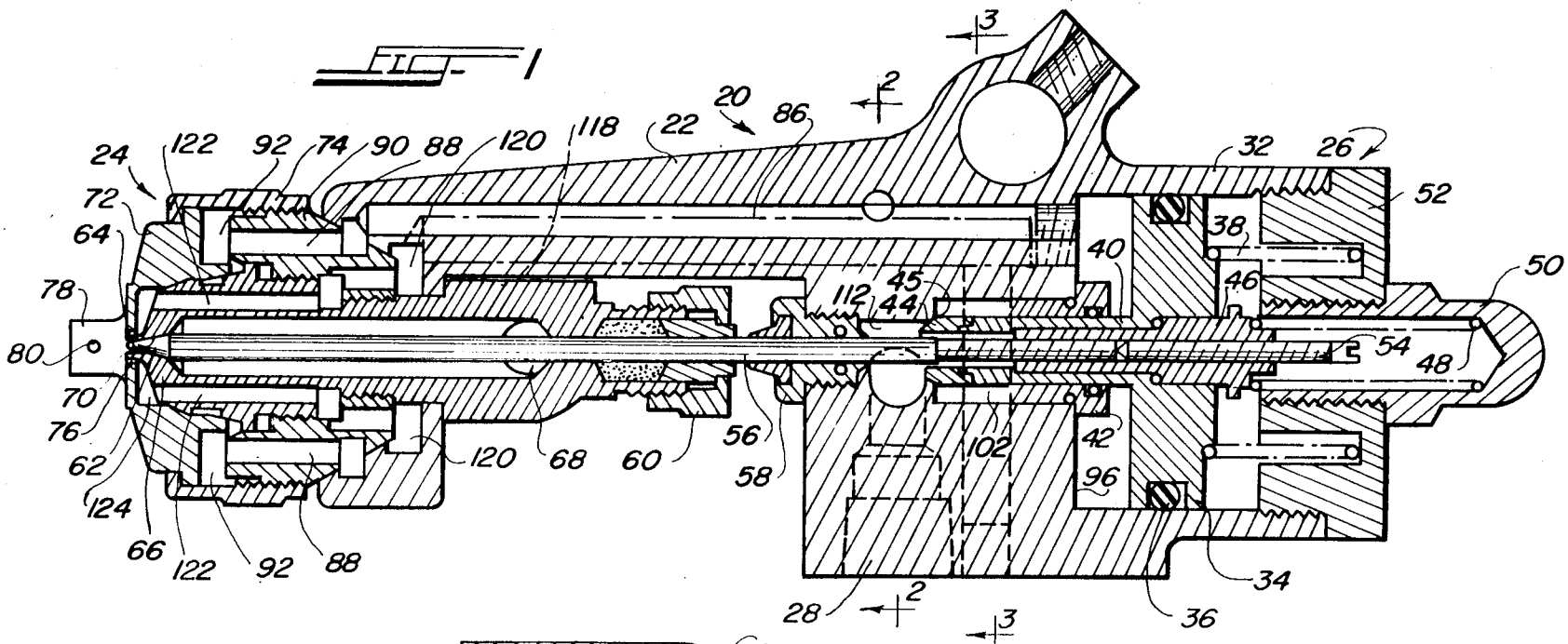
FIG. 1 is a cross sectional, side elevation view of an air atomizing spray gun constructed according to the teachings of the present invention.

FIG. 1 illustrates an air atomizing automatic spray gun 20 according to the teachings of the present invention. The spray gun has a body portion 22, at a forward end of which is carried a nozzle assembly 24 and at a rearward end of which is a pneumatic motor assembly 26. Formed in the body intermediate the nozzle and motor assemblies are atomizing and fan air inlets 28 and 30 for connection with respective supplies of air under pressure.

The pneumatic motor assembly 26 comprises a cylinder 32 formed by the rearward end of the gun body 22, in which is received a piston 34 having a circumferential seal 36. The piston is moved forwardly in the cylinder

BEST AVAILABLE COPY by a spring 38 and rearwardly against the urging of the spring by air under pressure introduced into the forward end of the cylinder through an air inlet (not shown) in the gun body, and includes an axially extending integral cylindrical member 40 that is slidable within a seal retainer 42 and defines at its forward end a valve 44 for abutting a seat 45 in the gun body when the piston is in its forward position. The arrangement of the valve and seat accommodates introduction of atomizing air to the nozzle assembly 24 when coating material is to be sprayed, as will be described.

A needle body 46 extends slidably through the piston 34 and into the piston member 40, and is urged forwardly by a spring 48 extending between the needle body and a cap 50 removably threaded into an end closure 52 of the cylinder 32. A needle locking screw 54 is threaded into and through the needle body, and extending from a forward end of the needle locking screw is a needle valve 56. The needle valve extends through an air valve gland housing 58 and a material packing screw 60 to the nozzle assembly 24, whereat it defines a valve portion 62 for movement against a seat 64 of a fluid nozzle 66 threaded onto the forward end of the gun body 22 in axial alignment with the needle valve.

The fluid nozzle 66 receives liquid coating material through an inlet 68, and has a circular outlet orifice 70 from which a cylindrical stream of the material is emitted upon retraction of the needle valve 56 from its seat 64. Disposed about the fluid nozzle in axial alignment therewith is an air cap 72 mounted on the gun body 22 by a retaining ring 74. The air cap defines an annular atomizing air outlet orifice 76 around the fluid nozzle outlet orifice, through which a cylindrical stream of air is emitted to atomize coating material exiting the fluid orifice into a conically-shaped spray pattern. The air cap also has a pair of opposed horns 78 having fan air outlet orifices 80 from which jets of air are directed against opposite sides of the conically-shaped spray to flatten it into a fan-shaped pattern.

According to the invention, the spray gun 20 is uniquely structured to accommodate two different means, depending upon the needs and requirements of a user, for providing atomizing and fan air to the nozzle assembly 24. In one arrangement of the structure, separate supplies of atomizing and fan air are connected to the gun, and valves on the gun permit individual adjustment of the flow rates of atomizing and fan air. In another arrangement, only a supply of atomizing air is connected to the gun, and a single valve adjustably diverts a portion of the atomizing air for fan shaping purposes.

Figure 2:
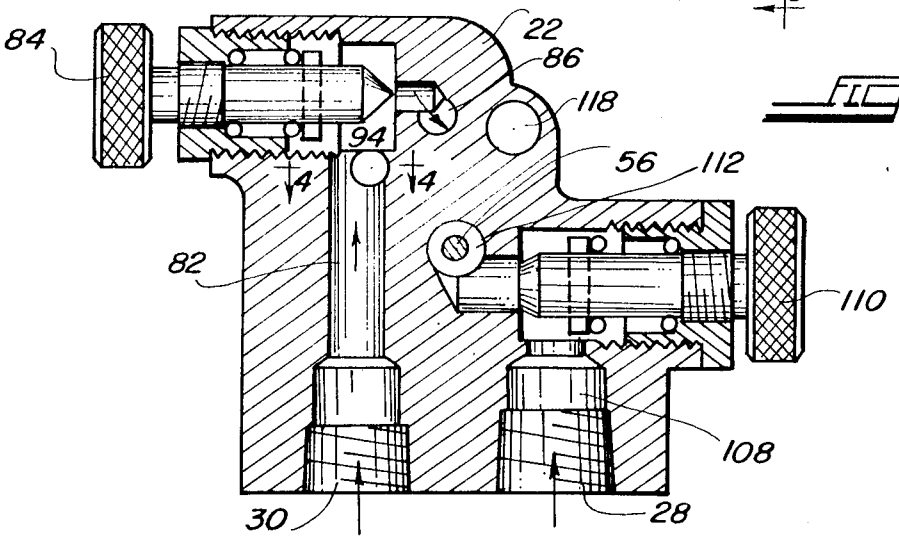
FIG. 2 is a cross sectional, side elevation view taken substantially along the lines 2—2 of FIG. 1, illustrating the spray gun structure when there are two air inlets to the gun and precise control may be separately exercised over each of atomizing and fan air.
Figure 3:
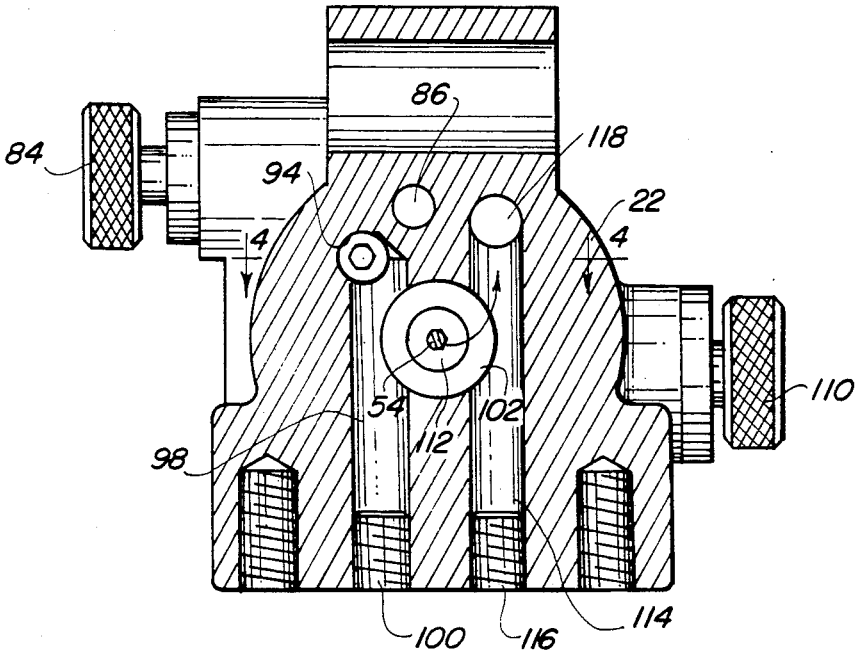
FIG. 3 is a cross sectional, side elevation view taeken substantially along the lines 3—3 of FIG. 1, illustrating further details of the gun when there are two air inlets.
Figure 4:
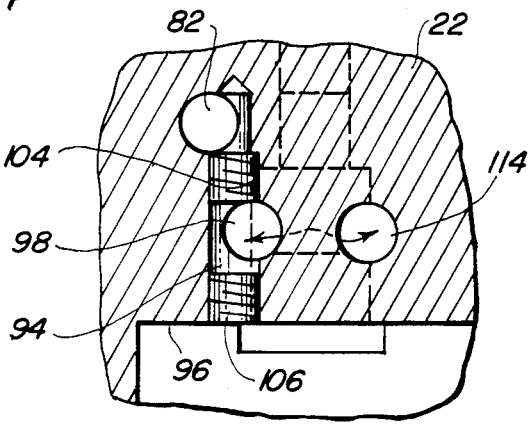
FIG. 4 is a cross sectional, top plan view taken substantially along the lines 4—4 of FIGS. 2 and 3, showing additional details of the gun when there are two air inlets.

The particular structure of the spray gun 20 that adapts it for connection to separate sources of atomizing and fan air is shown in FIGS. 2–4. With a source of air connected to the fan air inlet 30, as seen in FIG. 2 the air flows through a passage 82 to a fan air valve assembly 84 which is adjustable to control the opening between the passage 82 and a passage 86. The passage 86 extends forwardly through the gun body to passages 88 in an insert 90 of the nozzle assembly 24, and the passages 88 in turn open into a passage 92 defined between the air cap and insert, which passage 92 communicates with the fan air outlet orifices 80.

Also communicating with the fan air passage 82 is a passage 94 that extends longitudinally from a front wall 96 of the motor assembly 26 to a point just forward of the passage 82. Intermediate the passsage 82 and the wall 96, the passage 94 intercepts a vertically extending passage 98 that is closed at its lower end by a plug 100 and communicates with an annular chamber 102, in the gun body 22, that surrounds the cylindrical piston member 40 rearwardly of the seat 45 for the valve portion 44 of the member. Air does not, however, flow from the passage 82 through the passage 94, since for the condition where the spray gun is adapted for connection with separate sources of fan and atomizing air, the passage 94 is closed between the passages 82 and 98 by a removable plug 104 and between the passage 98 and wall 96 by a removable plug 106.

The flow path for atomizing air is from the inlet 28 through a passage 108 to an atomizing air control valve assembly 110, which controls the opening between the passage and an annular chamber 112 in the gun body 22 immediately forwardly of the seat 45 and chamber 102. When the pneumatic motor 26 retracts the needle valve 56 from its fluid nozzle seat 64, prior to moving the needle valve from its seat, rearward movement of the piston 34 moves the valve 44 from its seat 45 and establishes communication between the chambers 112 and 102 for a flow of atomizing air into the chamber 102.

In addition to communicating with the passage 98, the chamber 102 also communicates with a vertically extending passage 114, closed at its lower end by a plug 116. The passage 114 connects at its upper end with a passage 118 extending longitudinally forwardly through the gun body to an annular chamber 120, which in turn communicates through fluid nozzle passages 122 with a chamber 124, between the fluid nozzle and air cap 72, from which the atomizing air outlet 76 exits. Thus, upon energizing the motor assembly 26, a path is established for a flow of atomizing air from the inlet 28 to and through the atomizing air outlet.

An advantage to using separate sources of fan and atomizing air is that precise control may be exercised over the flow rate of each without affecting the flow rate of the other. The ability to control the flow rates individually is particularly important where the coating material being sprayed is difficult to atomize unless sufficient atomizing air is used. However, a disadvantage is that an additional supply line and air pressure regulator must be provided, so unless the capability of separately controlling fan and atomizing air is required, the arrangement may be inconvenient.

The invention therefore also contemplates that the spray gun be modifiable to enable only a single air source to be connected to the gun for supply of both fan and atomizing air. In this case, fan air is obtained and diverted from atomizing air supplied to the inlet 28 of the gun, so that increases in fan air result in decreases in atomizing air, and vice versa. Although the arrangement may not provide entirely satisfactory for all types of coating materials, it lends itself to use with those which are easily atomized with limited amounts of air.

Figure 5:
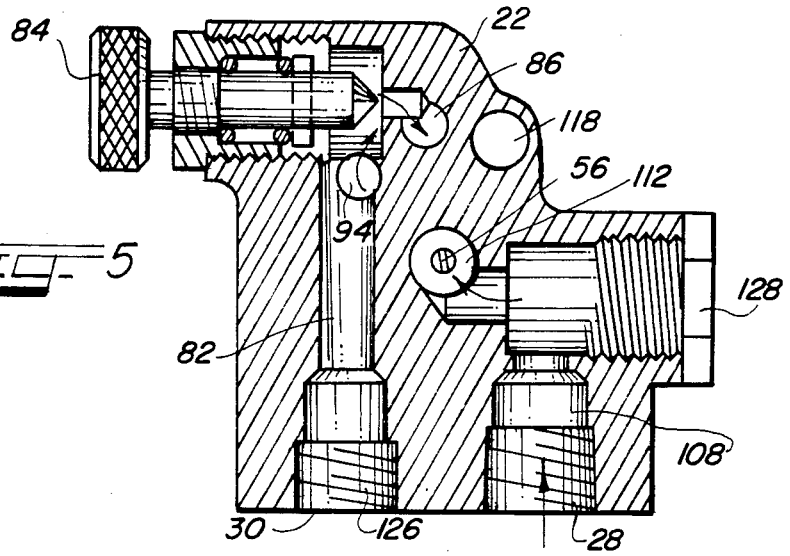
FIG. 5 is similar to FIG. 2, except that it shows the gun structure when there is a single air inlet to the gun for both atomizing and fan air.
Figure 6:
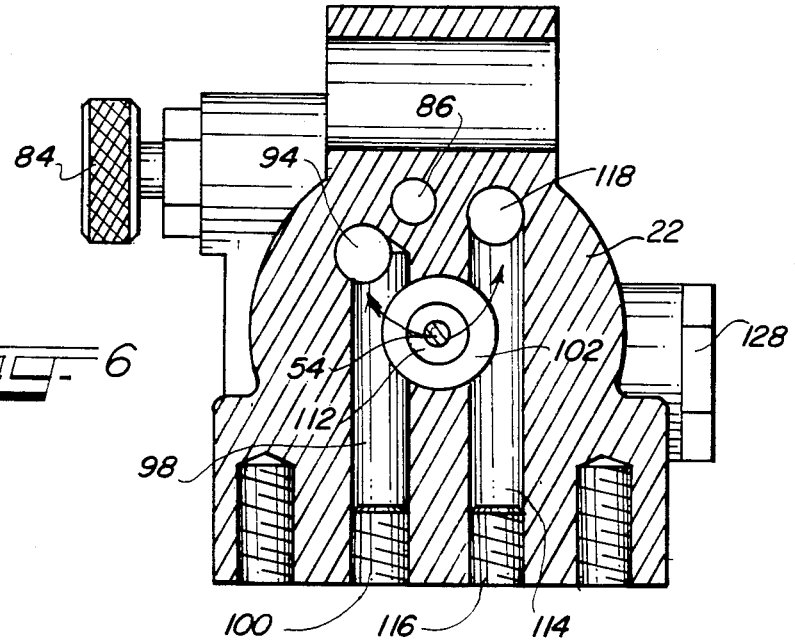
FIG. 6 is similar to FIG. 3, except that it shows the gun structure when there is a single air inlet.
Figure 7:
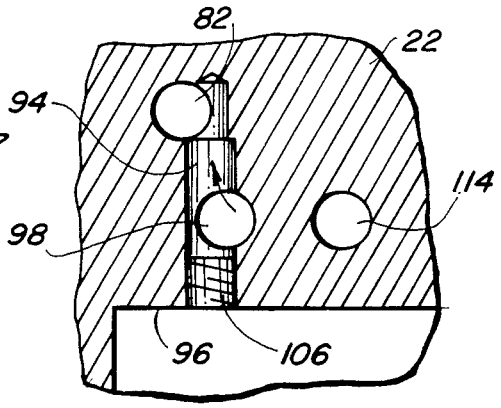
FIG. 7 is similar to FIG. 4, except that it shows the gun structure for a single air inlet.

As compared with the structure shown in FIGS. 2–4 for the condition when the gun is connected with two separate supplies of air, when only a single supply is connected, as seen in FIGS. 5–7 the fan air inlet 30 is closed by a plug 126, the atomizing air control valve 110 is replaced by a plug 128, and the plug 104 in the passage 94 is removed to connect the passages 82 and 98. Removal (or insertion) of the plug 104 is accomplished by disassembling the motor assembly 26 to provide access to the wall 96 and the plug 106, whereupon the plug 106 may be removed to accommodate removal (or insertion) of the plug 104, with the plug 106 then being replaced.

With the structure of the gun arranged as in FIGS. 5–7, upon actuation of the motor 26 to move the valve 44 from its seat 45, air introduced at the inlet 28 flows to the atomizing air orifice 76 along substantially the same path as described for the condition where two air sources were connected to the gun. However, since the atomizing air control valve 110 has been removed, in the absence of a flow of fan air, the flow rate of atomizing air is controlled solely by the pressure of air supplied to the gun.

On the other hand, unlike the arrangement where two separate air sources are connected to the gun, air for fan-shaping the spray is derived entirely from the air introduced at the inlet 28, and thus comprises air that would otherwise be directed to the atomizing air orifice 76. More particularly, when the valve 44 is moved from its seat 45 to connect the chambers 112 and 102, in addition to air entering the passage 114 for flow through the passage 118 to the atomizing air orifice 76, air from the chamber 102 also enters the passage 98 for flow through the now unblocked passage 94 to the passage 82, and thence through the fan air valve assembly 84 and the passage 86 to the fan air orifices 80.

As is apparent, since fan air is obtained from the chamber 102, it represents air that is diverted from and would otherwise be supplied to the atomizing air orifice 76. Therefore, increases in the volume flow rate of fan-shaping air, as determined by the setting of the fan air valve 84, result in decreases in the volume flow rate of atomizing air, and vice versa. Consequently, the arrangement results in some difficulty in controlling the flow rate of atomizing air. Nevertheless, the flow rates of fan and atomizing air can be adjusted by appropriate adjustment of both the pressure of air supplied to the gun and the setting of the fan air control valve, although the control is more difficult to implement than when the gun is connected with two sources of air.

Figure 8:
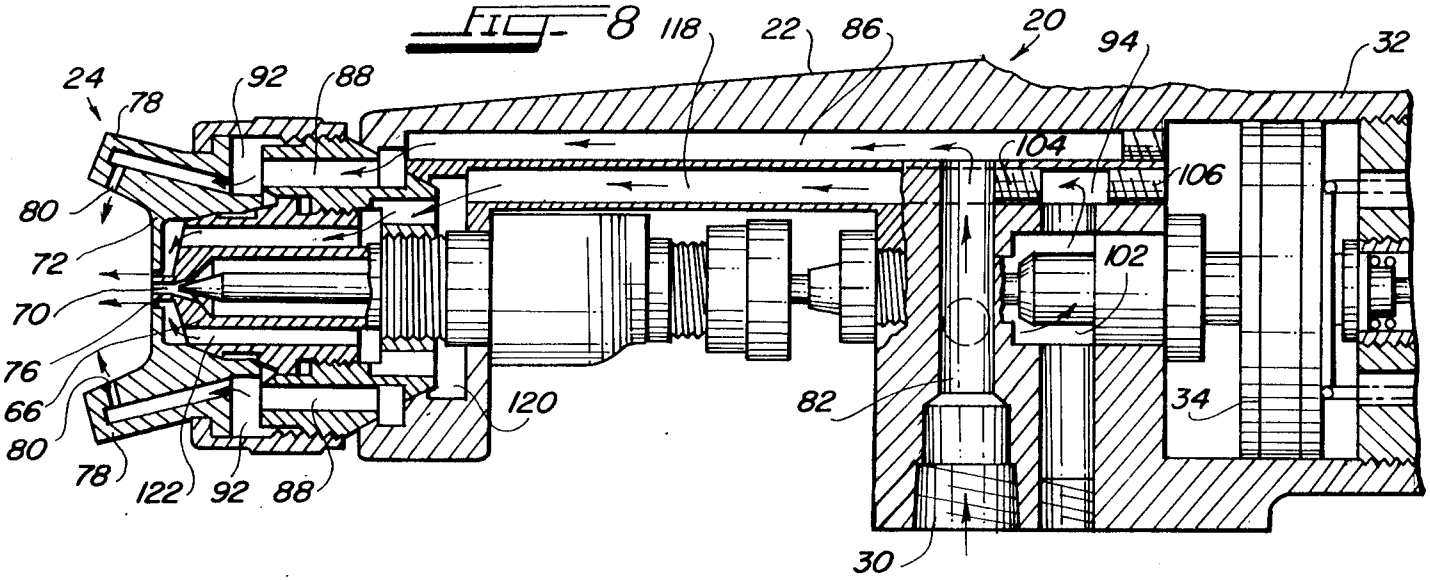
FIG. 8 is a cross sectional side elevation view, schematically illustrating air flow paths through the spray gun when there are two air inlets.
Figure 9:
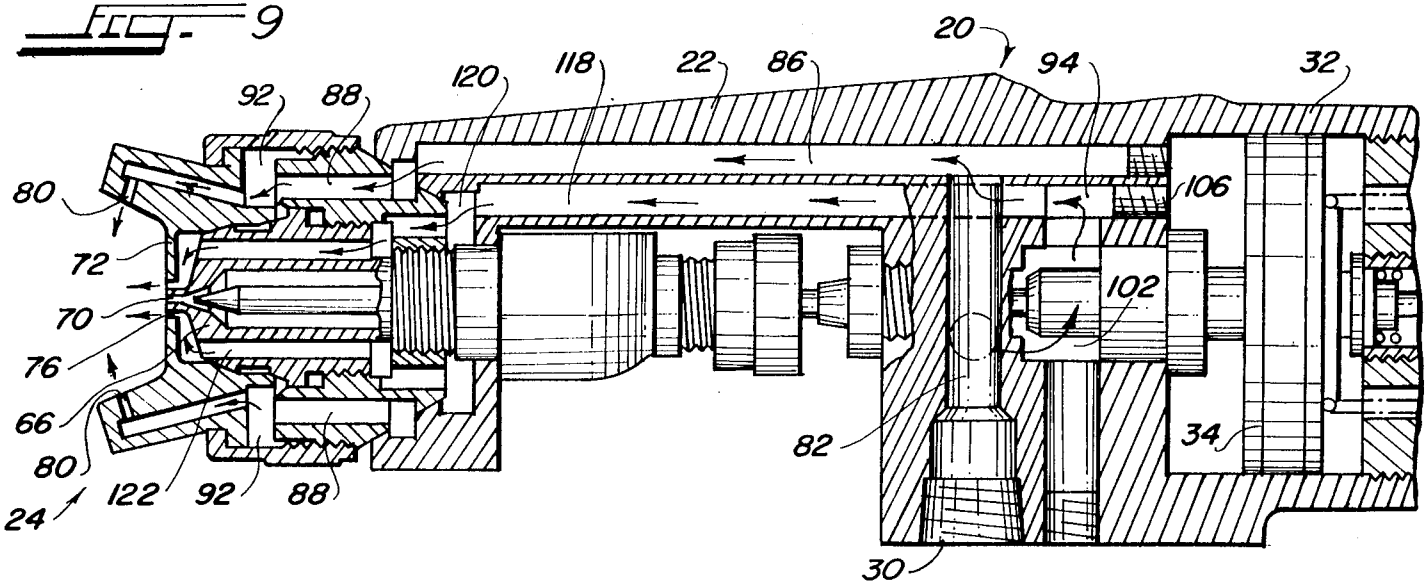
FIG. 9 is similar to FIG. 8, except that it schematically shows air flow paths through the gun when there is a single air inlet.

FIG. 8 schematically illustrates the air flow paths through the spray gun 20 when it is structured for connection with two separate sources of air, and FIG. 9 the air flow paths for the circumstance where the gun is connected with only a single source of air.

While one embodiment of the invention has been described in detail, various modifications and other embodiments thereof may be devised by one skilled in the art without departing from the spirit and scope of the invention, as defined in the appended claims.

What is claimed is:

1. An air atomizing spray gun for liquid coating material, said spray gun comprising a body and a nozzle assembly mounted on said body, said nozzle assembly having fluid outlet orifice means for emitting a stream of coating material, atomizing air orifice means for emitting air for atomizing the stream of coating material into a conically-shaped spray, and fan air orifice means for emitting air for impingement against opposite sides of the spray to flatten the spray into a fan-shaped pattern, said body having a pair of air inlets for connection with respective supplies of air under pressure and passage means for separately connecting one of said air inlets to said atomizing air orifice means and the other air inlet to said fan air orifice means, whereby fan and atomizing air may be separately supplied to said nozzle assembly, said passage means including a first passage extending between said one air inlet and said atomizing air orifice means, a second passage extending between said other air inlet and said fan air orifice means, and a third passage extending between said first and second passages, and further including means for selectively blocking said third passage, and means for selectively blocking one of said air inlets, so that when said third passage is blocked and neither of said air inlets is blocked, said atomizing air and fan air orifice means each receive air under pressure from a separate supply thereof, and so that when said third passage is unblocked to interconnect said first and second passages and one of said air inlets is blocked, said atomizing air and fan air orifice means each receive air under pressure from the same supply thereof.

2. A spray gun as in claim 1, including valve means on said body in communication with said second passage for controlling the flow of air to said fan air orifice means.

3. A spray gun as in claim 1, wherein said means for selectively blocking said third passage comprises a plug that is positionable in and removable from said third passage.

4. A spray gun as in claim 1, wherein said means for selectively blocking one of said air inlets comprises means for selectively blocking said other air inlet.

5. A spray gun as in claim 3, wherein said third passage is internally threaded and said plug is threaded and threadable into and out of said third passage.

* * * * *